US011142004B2

(12) United States Patent
Gabella et al.

(10) Patent No.: US 11,142,004 B2
(45) Date of Patent: Oct. 12, 2021

(54) SCANNING PRINTER CARRIAGE

(71) Applicant: HEWLETT-PACKARD DEVELOPMENT COMPANY, L.P., Spring, TX (US)

(72) Inventors: Jaime Abel Blanco Gabella, Sant Cugat del Valles (ES); Sergio Villar Garcia, Sant Cugat del Valles (ES); Alvaro Ponce Arevalo, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/608,823

(22) PCT Filed: Oct. 4, 2017

(86) PCT No.: PCT/US2017/055110

§ 371 (c)(1),
(2) Date: Oct. 26, 2019

(87) PCT Pub. No.: WO2019/070251

PCT Pub. Date: Apr. 11, 2019

(65) Prior Publication Data

US 2020/0223240 A1 Jul. 16, 2020

(51) Int. Cl.
*B41J 25/00* (2006.01)

(52) U.S. Cl.
CPC ..... *B41J 25/001* (2013.01)

(58) Field of Classification Search
CPC ..... B41J 25/001; B41J 19/005; B41J 19/202; B41J 29/38

(Continued)

(56) References Cited

U.S. PATENT DOCUMENTS 5,779,376 A 7/1998 Seu
6,789,966 B2 9/2004 Tanaka et al.

(Continued)

FOREIGN PATENT DOCUMENTS

EP 2903407 8/2015
JP 03190774 8/1991

(Continued)

OTHER PUBLICATIONS

Magennis, N., Five Ways to Print Wirelessly, Oct. 21, 2011, https://www.cnet.com/how-to/five-ways-to-print-wirelessly/.

*Primary Examiner* — Huan H Tran
*Assistant Examiner* — Alexander D Shenderov
(74) *Attorney, Agent, or Firm* — HP Inc. Patent Department

(57) ABSTRACT

The present disclosure provides an imaging apparatus (100) comprising a scanning printer carriage (110), a carriage motor (120), a transmission belt (130) between the carriage motor (120) and the scanning printer carriage (110), a data control unit (140) to provide print data (200) to the carriage motor (120) and the scanning printer carriage (110), and a power source (150) to provide power (300) to the carriage motor (120), and the scanning printer carriage (110). The data control unit (140) transmits print data (200) to the scanning printer carriage (110) by wireless data transfer (201), and the power source (150) transmits power (300) to the scanning printer carriage (110) through an electrically conductive element (302) in the transmission belt (130).

13 Claims, 6 Drawing Sheets

(58) Field of Classification Search
USPC ..... 347/37
See application file for complete search history.

(56) References Cited

U.S. PATENT DOCUMENTS

| | | | | |
|---|---|---|---|---|
| 6,919,115 | B2 | 7/2005 | Foster | |
| 8,767,229 | B2 | 7/2014 | Murray et al. | |
| 2003/0085946 | A1 | 5/2003 | Meados | |
| 2005/0001876 | A1 | 1/2005 | Kato | |
| 2005/0007404 | A1* | 1/2005 | Usui | B41J 2/2139 347/14 |
| 2014/0146103 | A1 | 5/2014 | Yokozawa | |
| 2015/0285334 | A1 | 10/2015 | Thomas et al. | |
| 2015/0343814 | A1* | 12/2015 | Otsuka | B41J 19/30 347/9 |
| 2017/0146943 | A1 | 5/2017 | Ito et al. | |

FOREIGN PATENT DOCUMENTS

| | | |
|---|---|---|
| JP | 07323538 | 12/1995 |
| JP | 2000141829 | 5/2000 |
| JP | 2001158153 | 6/2001 |
| JP | 2002283544 | 10/2002 |
| JP | 2003170637 | 6/2003 |
| JP | 2003305836 | 10/2003 |
| JP | 2008183845 | 8/2008 |
| JP | 2010009556 | 1/2010 |
| JP | 2011046118 | 3/2011 |
| JP | 2011110920 | 6/2011 |
| JP | 2012232500 | 11/2012 |
| JP | 2015174324 | 10/2015 |
| JP | 2015183265 | 11/2015 |
| JP | 2015223803 | 12/2015 |

* cited by examiner

SCANNING PRINTER CARRIAGE

BACKGROUND

In imaging devices, such as inkjet printer systems, the printheads are contained within a moving printer carriage, and the printer carriage is scanned, back and forth across the print medium, along carriage rails that are disposed perpendicular to the print direction.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

In the drawings, like parts are denoted by like reference numerals.

DETAILED DESCRIPTION

Some printer systems, such as serial dot matrix, piezo and thermal inkjet printers, employ a scanning printer carriage which traverses along a scanning rail (or set of rails) that are disposed parallel to the print medium surface, and perpendicular to the print direction. Electrical power and print data are provided to the printer carriage, and feedback data may also be received from the printer carriage, whilst the printer carriage is scanning back and forth across the print medium. The data and power is provided by at least one dedicated cable to the scanning printer carriage.

Figure 1:
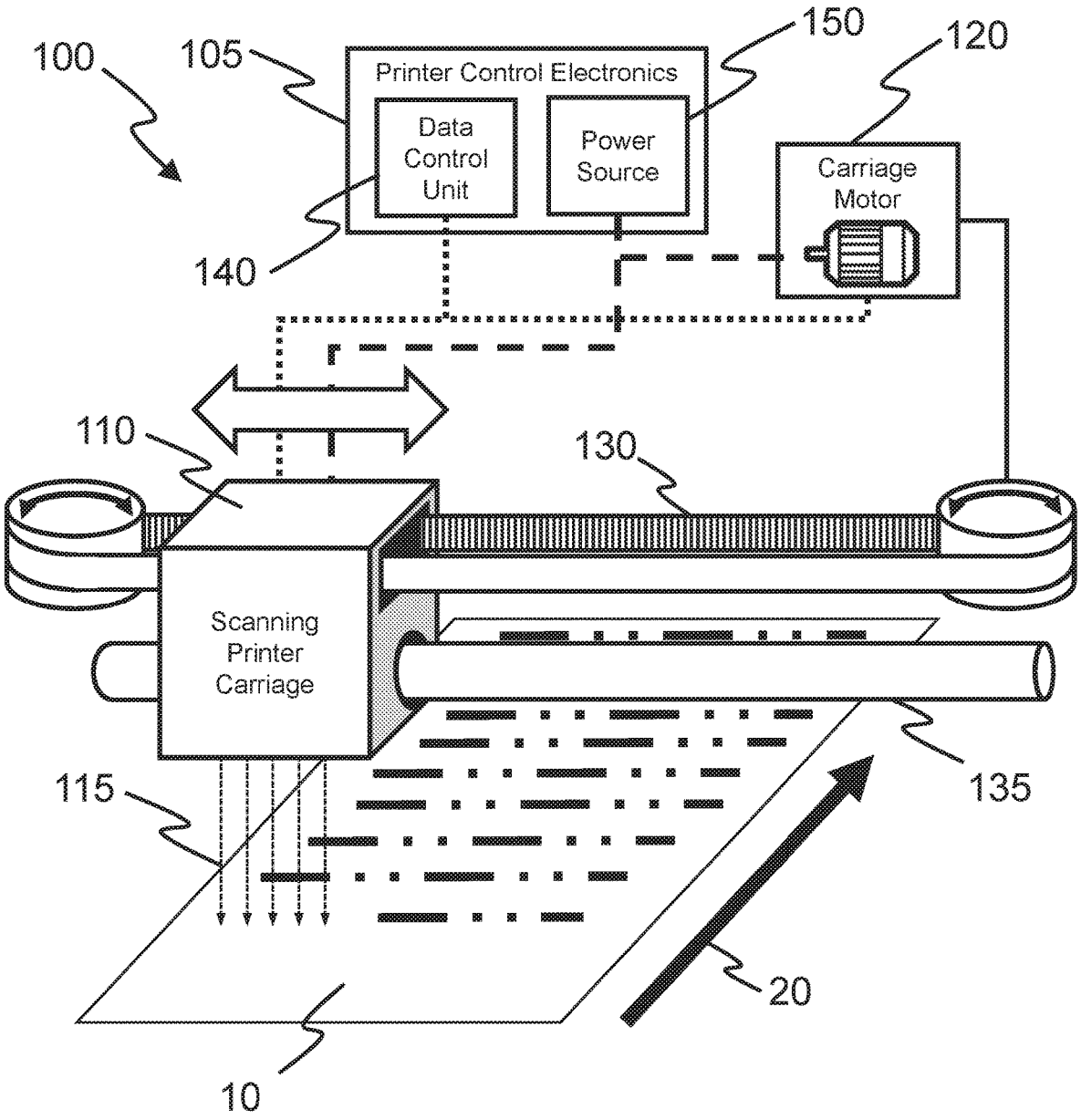
FIG. 1 is a simplified view of an example printer system.

FIG. 1 shows an example printer system 100 having a scanning printer carriage 110 which moves along a scanning rail 135. The scanning printer carriage 110 contains the printer system printheads, and in some examples, the printing fluid reservoir(s), e.g. ink cartridge(s). The printheads eject ink 115 onto the print medium 10 below the scanning printer carriage 110.

A carriage motor 120 drives a transmission belt 130, which accelerates and decelerates the scanning printer carriage 110, back and forth, across the print medium 10 perpendicular to the print direction 20. In some examples, the position of the scanning printer carriage 110 can be controlled to within under a tenth of a millimetre. In some examples, the print process can run both when the scanning printer carriage 110 is scanned in a first direction (for example, from left to right across the width of the print medium 10), and in a second direction (for example, from right to left across the width of the print medium 10) along the scanning rail(s) 135, allowing an increase in printing speeds.

The example shown, print medium 10 is moved relative to the scanning printer carriage 110 in the print direction 20.

In some examples, the print medium 10 is stationary, and scanning printer carriage and associated components are moved opposite to the print direction 20, as well as scanning back and forth along the scanning rail(s) 135 across the print medium 10.

The transmission belt 130 is driven by the carriage motor 140, and in some examples, the scanning printer carriage 110 may be attached to a designated point along one side of the transmission belt 130. As the carriage motor 140 drives the transmission belt 130, the scanning printer carriage 110 is impelled along the scanning rail(s) 135 by the transmission belt 130. In some examples, the transmission belt 130 is a toothed rubber belt held under tension. In some examples, the transmission belt 130 may be a drive wire, driven back and forth by a winch driven by the carriage motor 120. Drive wires are also under tension so as to eliminate any play in the wire. The drive wires may be bare wire, capable of conducting electricity, for example.

The example printer system 100 has one or more printed circuit boards (PCBs), which comprise the printer control electronics 105 used to both control and power the internal components of the printer system 100. A printed circuit board mechanically supports and electrically connects electronic components using conductive tracks, pads and other features etched from copper sheets laminated onto a non-conductive substrate. Multiple PCBs may be connected to each other via one or more buses.

In the example shown in FIG. 1, the printer control electronics 105 include a data control unit 140 that transmits the print data to the scanning printer carriage 110. The print data transmitted from the data control unit to each printhead in the scanning printer carriage 110 may comprise, for example, information relating to the colour, volume and timing for ejection of each ink droplet 115. Instructions for effecting movement of the scanning printer carriage 110 are sent from the data control unit 140 to the carriage motor 120. The print data 200 and instructions effecting movement are transmitted along dedicated cables, shown as dotted lines in FIG. 1.

The printer control electronics 105 also include a power source 150 which provides electrical power to the printheads within the scanning printer carriage 110, and the carriage motor 120. The power is transmitted along dedicated cables, shown as dashed lines in FIG. 1. In this example, the same power source 150 supplies power to both the carriage motor 120 and the scanning printer carriage 110.

Recent examples of printer systems have incorporated flat and flexible "membrane" data and/or power cables, which are connected to the printer system toward the middle of the scan axis, allowing the scanning printer carriage 110 to scan back and forth along the scan rail 135, and the power/data cable(s) to follow the scanning printer carriage 110 by folding and double-backing into a connector on the scanning printer carriage 110.

The dedicated power and/or data cable(s) lead to extra components in the printer system 100, for example connectors, springs, cable guides, grease etc. With a greater number of components comes the greater possibility of mechanical issues due to the complex movement dynamics, e.g. following the scanning printer carriage 110 as it traverses the scan rail 135.

In accordance with example descriptions of printer system 100 having a scanning printer carriage 110, cabling for data communication and power transmission from the printer control electronics 105 to the scanning printer carriage 110 may be reduced, for example.

Figure 2A:
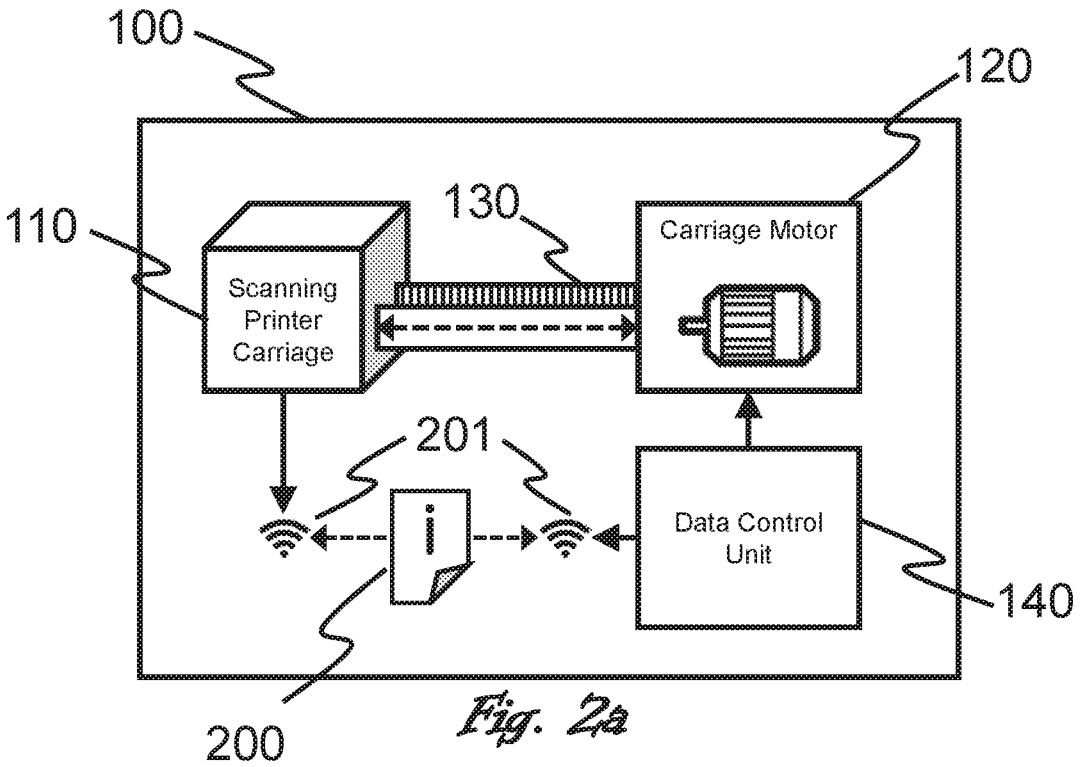
FIG. 2*a* is a schematic diagram of an example printer system transmitting data.

FIG. 2*a* shows an example of the present disclosure wherein print data is transmitted to the scanning printer carriage via a wireless transmission protocol, instead of over a dedicated ribbon or cable.

In the schematic example shown in FIG. 2*a*, the printer system 100 comprises a scanning printer carriage 110, a carriage motor 120, and a transmission belt 130 between the carriage motor 120 and the scanning printer carriage 110. The carriage motor 120 uses the transmission belt to drive the scanning printer carriage 110 back and forth along scanning rail(s) across the print medium, perpendicular to the print direction.

The printer system 100 also comprises a data control unit 140 which transmits print data 200 to the scanning printer carriage 110. In the example shown, the instructions for effecting movement of the scanning printer carriage 110 are transmitted from the data control unit 140 to the carriage motor 120 through physical wiring/circuitry.

In the example shown, both the data control unit 140 and the scanning printer carriage 110 each comprise a wireless communication node 201. A wireless transmission node 201 comprises at least one of a transmitter (to transmit data) and a receiver (to receive data). In some examples, the wireless transmission nodes 201 are transceivers, i.e. transmitter and receivers. The data control unit 140 transmits the print data 200 to the scanning print carriage 110 via the wireless communication nodes 201.

Figure 2B:
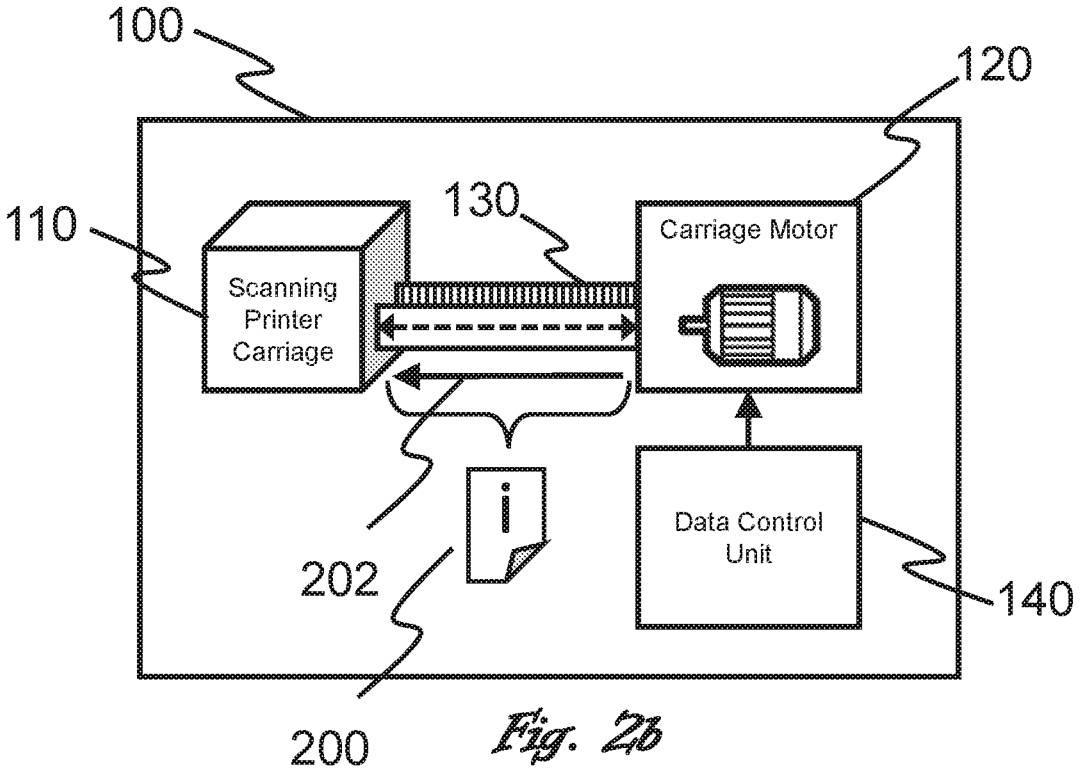
FIG. 2*b* is a schematic diagram of an example printer system transmitting data.

FIG. 2*b* shows an example of the present disclosure wherein print data is transmitted to the scanning printer carriage via an electrically conductive element in the transmission belt, instead of over a dedicated ribbon or cable. For example, the electrically conductive element might be a flexible conductive membrane disposed alongside a rubber belt, and left exposed on one side so as to provide conductive access as the belt is driven. An electric brush may be used at the terminal with the power source to maintain electric contact between the terminal and the moving transmission belt 130.

In the schematic example shown in FIG. 2*b*, the printer system 100 comprises a scanning printer carriage 110, a carriage motor 120, and a transmission belt 130 between the carriage motor 120 and the scanning printer carriage 110. The carriage motor 120 uses the transmission belt to drive the scanning printer carriage 110 back and forth along scanning rail(s) across the print medium, perpendicular to the print direction 20 (i.e. the direction of media advance).

The printer system 100 also comprises a data control unit 140 which transmits print data 200 to the scanning printer carriage 110. In the example shown, the instructions for effecting movement of the scanning printer carriage 110 are transmitted from the data control unit 140 to the carriage motor 120 through physical wiring/circuitry.

In the example shown, the transmission belt 130 comprises an electrically conductive element 202. The data control unit 140 transmits the print data 200 to the scanning print carriage 110 through the electrically conductive element 202 in the transmission belt 130.

Figure 3A:
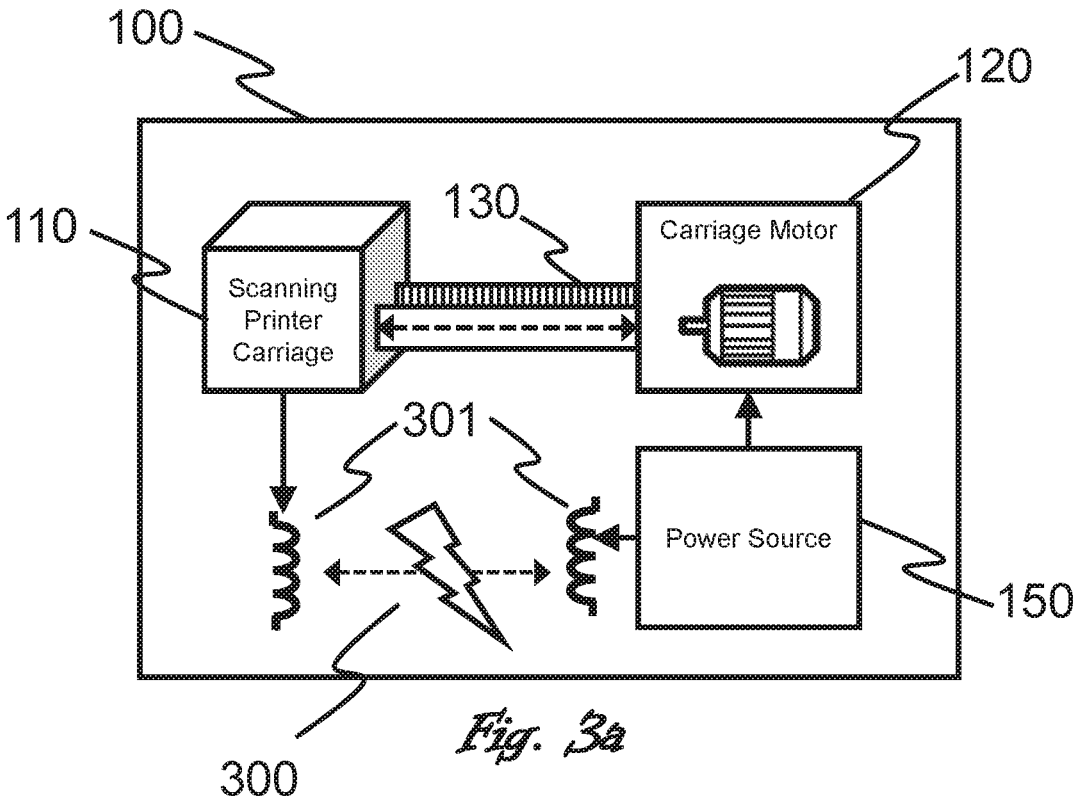
FIG. 3*a* is a schematic diagram of an example printer system transmitting power.

FIG. 3*a* shows an example of the present disclosure wherein electrical power is transmitted to the scanning printer carriage via electromagnetic induction, instead of over a dedicated ribbon or cable. Electromagnetic induction can be used to transfer energy between two objects. Energy is sent through an inductive coupling to an electrical device, which can then use that energy to charge or run the device.

A first induction coil in a first device creates an alternating electromagnetic field, and a second induction coil in a second device takes power from the electromagnetic field and converts it back into electric current to charge a battery or run the device. The two induction coils in proximity combine to form an electrical transformer.

In the schematic example shown in FIG. 3*a*, the printer system 100 comprises a scanning printer carriage 110, a carriage motor 120, and a transmission belt 130 between the carriage motor 120 and the scanning printer carriage 110. The carriage motor 120 uses the transmission belt to drive the scanning printer carriage 110 back and forth along scanning rail(s) across the print medium, perpendicular to the print direction.

The printer system 100 also comprises a power source 150 which transmits electrical power to both the carriage motor 120 and to the scanning printer carriage 110. In the example shown, power is transmitted from the power source 150 to the carriage motor 120 through physical wiring/circuitry.

In the example shown, both the power source 150 and the scanning printer carriage 110 each comprise an electromagnetic induction coil 301. The power source 150 transmits power 300 to the scanning print carriage 110 through electromagnetic induction between the electromagnetic induction coils 301.

Figure 3B:
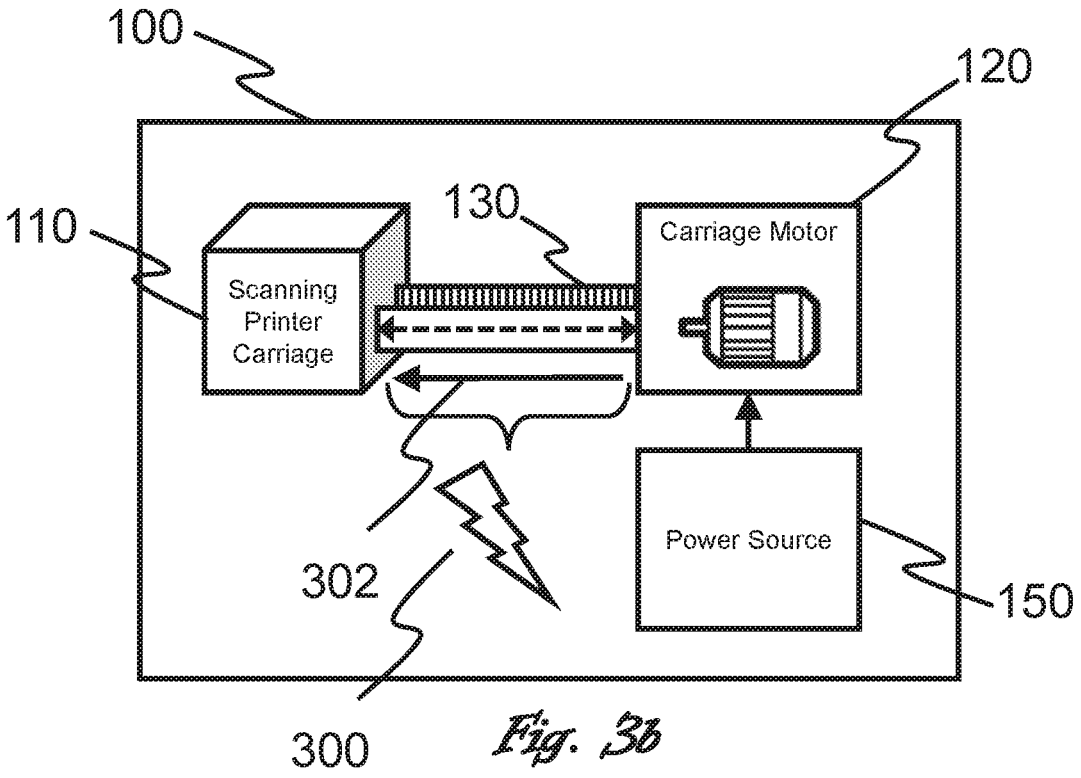
FIG. 3*b* is a schematic diagram of an example printer system transmitting power.

FIG. 3*b* shows an example of the present disclosure wherein power is transmitted to the scanning printer carriage via an electrically conductive element in the transmission belt, instead of over a dedicated ribbon or cable.

In the schematic example shown in FIG. 3*b*, the printer system 100 comprises a scanning printer carriage 110, a carriage motor 120, and a transmission belt 130 between the carriage motor 120 and the scanning printer carriage 110. The carriage motor 120 uses the transmission belt to drive the scanning printer carriage 110 back and forth along scanning rail(s) across the print medium, perpendicular to the print direction.

The printer system 100 also comprises a power source 150 which transmits power to both the carriage motor 120 and to the scanning printer carriage 110. In the example shown, the power is transmitted from the power source 150 to the carriage motor 120 through physical wiring/circuitry.

In the example shown, the transmission belt 130 comprises an electrically conductive element 302. The power source 150 transmits the power 300 to the scanning print carriage 110 through the electrically conductive element 302 in the transmission belt 130.

Figure 4:
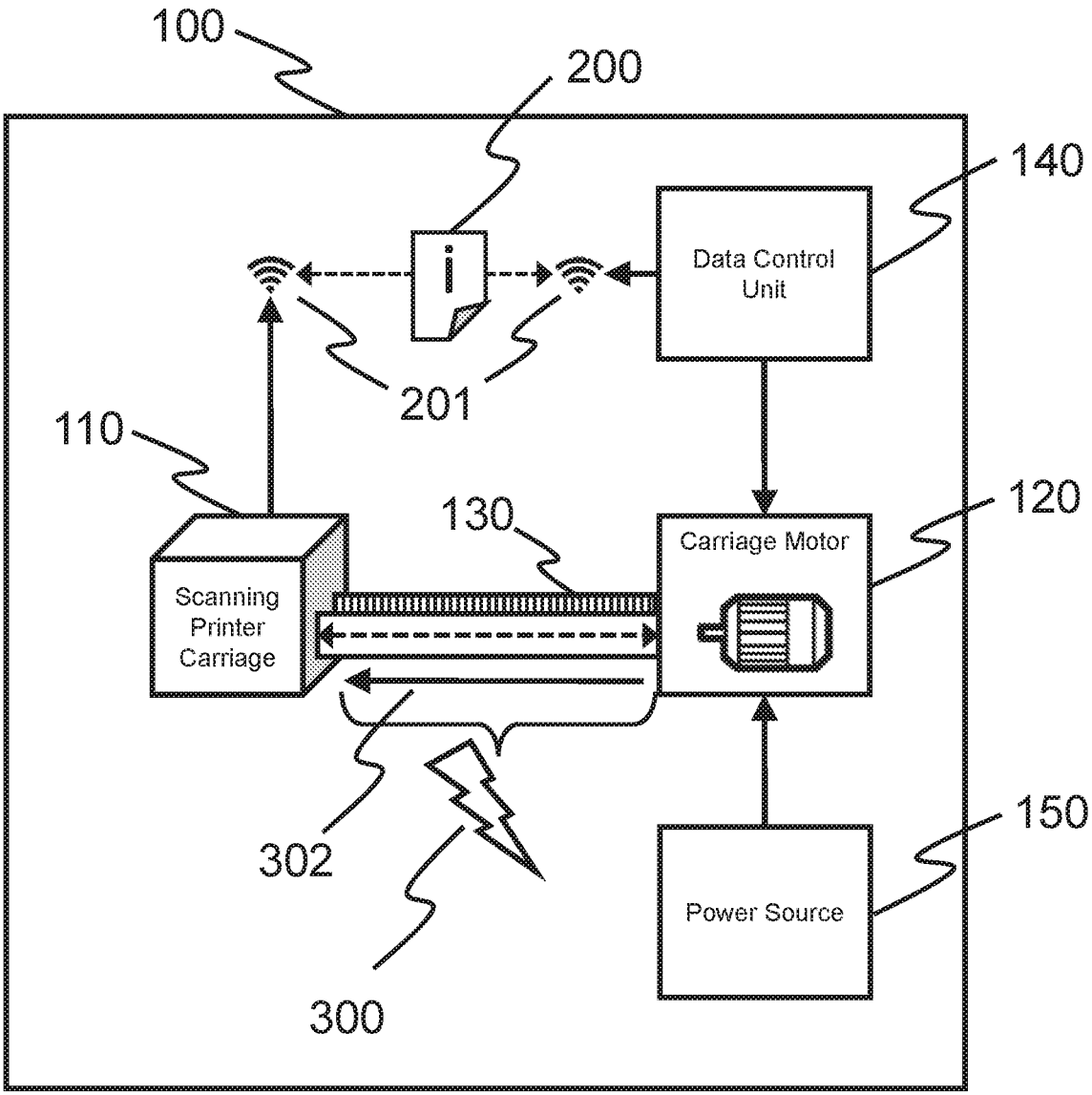
FIG. 4 is a schematic diagram of an example printer system, transmitting both data and power.

FIG. 4 shows an example of the present disclosure, wherein print data is transmitted to the scanning printer carriage via a wireless transmission protocol, and power is transmitted to the scanning printer carriage via an electrically conductive element in the transmission belt.

In the schematic example shown in FIG. 4, the printer system 100 comprises a scanning printer carriage 110, a carriage motor 120, and a transmission belt 130 between the carriage motor 120 and the scanning printer carriage 110. The carriage motor 120 uses the transmission belt to drive the scanning printer carriage 110 back and forth along scanning rail(s) across the print medium, perpendicular to the print direction.

The printer system 100 also comprises a data control unit 140 which transmits print data 200 to the scanning printer carriage 110. In the example shown, the instructions for effecting movement of the scanning printer carriage 110 are transmitted from the data control unit 140 to the carriage motor 120 through physical wiring/circuitry.

In the example shown, the data control unit 140 and the scanning printer carriage 110 each comprises a wireless communication node 201. The data control unit 140 transmits the print data 200 to the scanning print carriage 110 between the wireless communication nodes 201. In some examples, feedback data may also be received by the data control unit 140 from the scanning print carriage 110.

The printer system 100 also comprises a power source 150 which transmits power to both the carriage motor 120 and to the scanning printer carriage 110. In the example shown, the power is transmitted from the power source 150 to the carriage motor 120 through physical wiring/circuitry.

In the example shown, the transmission belt 130 comprises an electrically conductive element 302. The power source 150 transmits the power 300 to the scanning print carriage 110 through the electrically conductive element 302 in the transmission belt 130.

Figure 5:
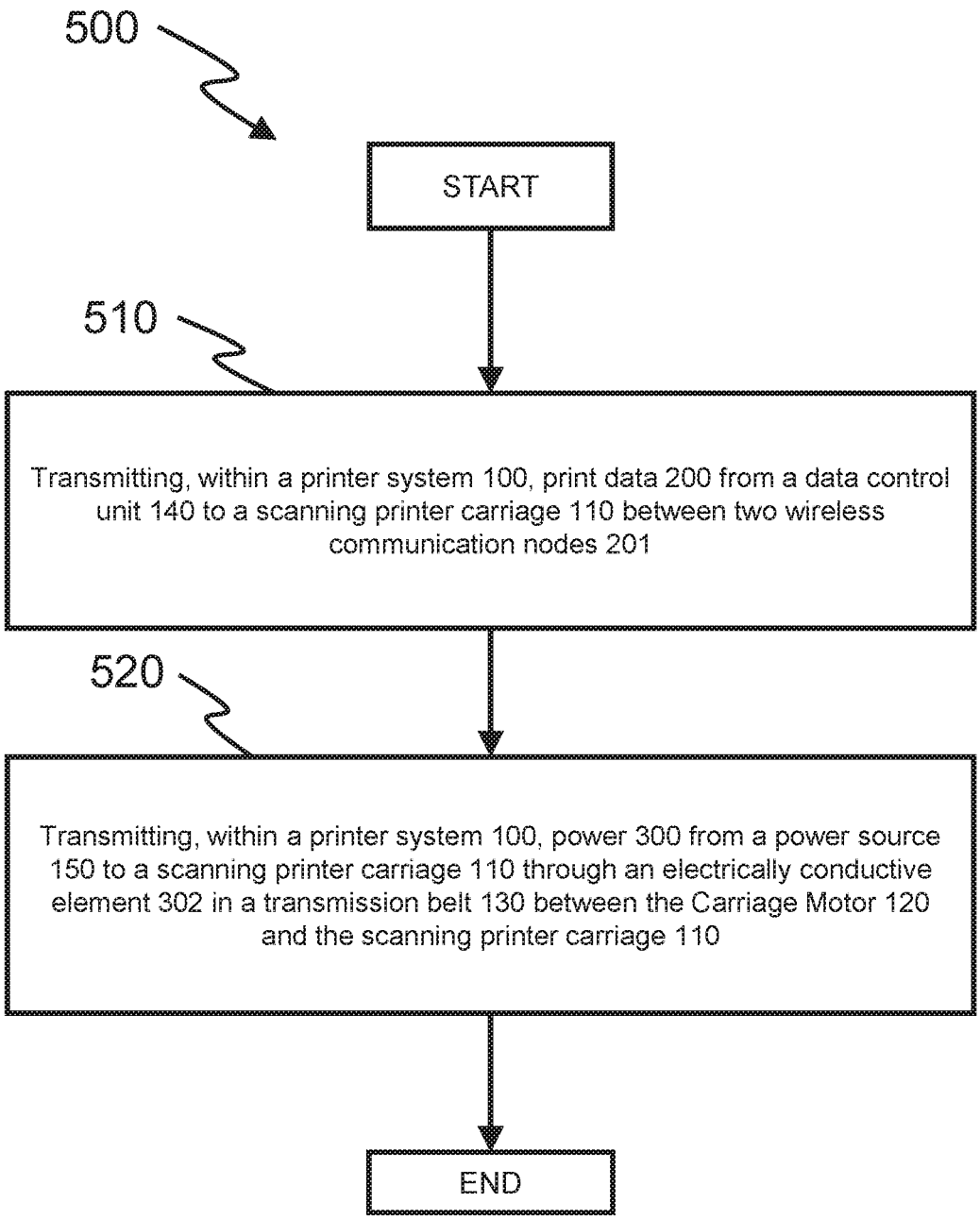
FIG. 5 is a flow chart of an example method.

FIG. 5 shows an example method 500 according to the printer system 100 shown in FIG. 4. In block 510, the method comprises transmitting, within a printer system 100, print data 200 from a data control unit 140 to a scanning printer carriage 110 between two wireless communication nodes 201.

In block 520, the method comprises transmitting, within a printer system 100, power 300 from a power source 150 to a scanning printer carriage 110 through an electrically conductive element 302 in a transmission belt 130 between the carriage motor 120 and the scanning printer carriage 110.

Figure 6:
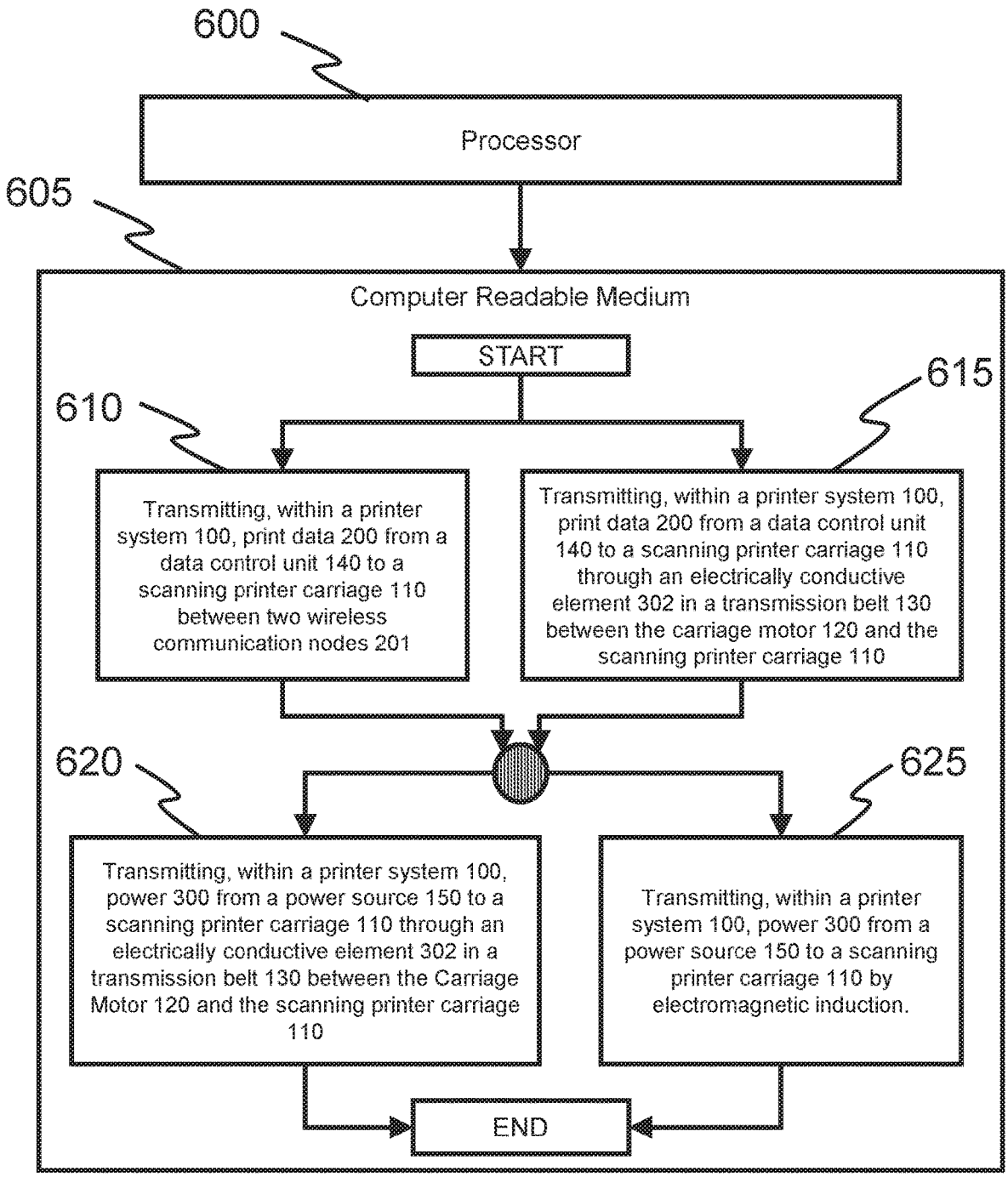
FIG. 6 is a schematic representation of a computer-readable medium according to an example.

FIG. 6 shows an example of a non-transitory computer-readable storage medium 605 comprising a set of computer readable instructions 610, 615, 620, 625 which, when executed by at least one processor 600 associated with an imaging device, cause the processor 600 to perform one of the methods according to examples described herein. The computer readable instructions 610, 615, 620, 625 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

In one example, at block 610, the method comprises transmitting, within a printer system 100, print data 200 from a data control unit 140 to a scanning printer carriage 110 between two wireless communication nodes 201.

In another example, at block 615, the method comprises transmitting, within a printer system 100, print data 200 from a data control unit 140 to a scanning printer carriage 110 through an electrically conductive element 302 in a transmission belt 130 between the carriage motor 120 and the scanning printer carriage 110.

In block 620, the method comprises transmitting, within a printer system 100, power 300 from a power source 150 to a scanning printer carriage 110 through an electrically conductive element 302 in a transmission belt 130 between the carriage motor 120 and the scanning printer carriage 110. In block 625, the method may instead comprise transmitting, within a printer system 100, power 300 from a power source 150 to a scanning printer carriage 110 by electromagnetic induction.

In some examples, the wireless communication nodes 201 used to transmit the print data 200 may incorporate an antenna on a printed trace circuit, and may be embedded in the data control unit 140 and the scanning printed carriage 110 themselves.

In some examples, the power transmission system is implemented by a driving wire which drives the scanning printer carriage 110 along the scanning rail(s) 135 and provides electric power 300 to the scanning printer carriage 110 for printing purposes. Electric power supply embedded within the mechanical impelling system could be based on a wire, a metallic belt, or any conductive element able to transmit forces with dynamic resistance. In one example, an electrical connection is maintained between the power source 150 and the transmission belt 130 by using a brush contact on the transmission belt 130. This allows for power 300 to be transmitted through the transmission belt 130 even when the transmission belt is moving.

The wireless data transmission in any of the above examples may be implemented through any of a number of existing wireless protocols, including, but not limited to: wireless personal area network protocols (e.g., BLUETOOTH, ZIGBEE); wireless local area network protocols (e.g., WIFI); other IEEE 802.X standard protocols; radio; or infrared.

WIFI transmission offers appropriate data transmission speed and transmission range for imaging devices such as printer systems.

BLUETOOTH transmission offers easy device integration and so can be easily incorporated into custom designs.

Infrared data transmission is easily implemented into devices, and is a convenient choice when there is line of sight between the transmitter and receiver.

In some examples, the printer system 100 may incorporate more than two wireless communication nodes 201 and/or electromagnetic induction coils 301 along the scan axis of the scanning printer carriage 110. This allows for redundancy in the data and/or power transmission. For example, in the event that print data 200 is not successfully transmitted between a first wireless communication node 201 within the printer system 100 and the scanning printer carriage 110, a third (or subsequent) wireless communication node 201 may transmit the print data 200. Similarly, a plurality of electromagnetic induction coils 301 located in close proximity along the scan axis of the scanning printer carriage 110 would provide a more robust power supply to the scanning printer carriage 110 as it traverses the scanning rail 135. The greater the number of electromagnetic induction coils 301, and the closer their proximity to the scanning printer carriage 110, the more efficient the transfer of power 300 will be through electromagnetic induction.

In some examples the scanning printer carriage 110 moves with the transmission belt 130, as the transmission belt 130 is accelerated and decelerated by the carriage motor 120. In the examples above where: print data 200; power 300; or both print data 200 and power 300 are transmitted through a conductive element 202, 302 in the transmission belt 130 to the scanning printer carriage 110, the print data 200 and/or power 300 can be retrieved by standard electrical terminals terminating in the scanning print carriage 110. The print data 200 and/or power 300 can then be directed to the corresponding internal components within the scanning printer carriage 110 by internal wiring and circuitry.

In the examples above where: print data 200; power 300; or both print data 200 and power 300 are transmitted either through a wireless communication protocol or electromagnetic induction (as appropriate) to the scanning printer carriage 110, the print data 200 and/or power 300 can be retrieved by a wireless communication node 201 and/or an electromagnetic induction coil 301 in the scanning print carriage 110.

In some examples, the wireless transmission nodes 201 comprise memory in the form of a buffer, so as to aid the continuous and smooth transmission of print data 200 between the data control unit 140 and the scanning printer carriage 110.

In some examples, the wireless transmission protocol incorporates an error detecting/checking code such as a cyclic redundancy check (CRC). CRC is used to detect accidental changes (errors and corruption) in raw data. Upon transmission, blocks of data are provided with a short calculation check value. Upon receipt of the data, the check calculation is repeated and, in the event the check values do not match, corrective action can be taken against data corruption. CRCs can be used for error correction, as well as identification.

In some examples, the print data 200 is transmitted continuously between the data control unit 140 and the scanning printer carriage 110 during the printing operation. In other examples, the print data 200 is transmitted from the data control unit 140 in bursts of data to the scanning printer carriage 110. Each burst of print data 200 comprises information for an entire line of printing, e.g. all at once for a single print line.

In some examples both the print data 200 and/or power 300 are transmitted over the same communication/power channel. For example, a single electrically conductive element 202/302 can be used to provide both print data 200 and power 300 to the scanning printer carriage 110 by integrating a data signal into the power signal, e.g. power-line communication (PLC). In another example, the transmission belt 130 may comprise two (or more) conductive elements 202, 302 through which the print data 200 and the power 300 may be transmitted, separately. In another example, both print data 200 and power 300 can be transmitted via electromagnetic induction.

The present disclosure provides a scanning printer system 100 that may reduce the number of any physical cables for print data 200 transfer or power 300 supply. It may be possible to reduce the number of moving dynamic cables, hence lowering the risk of damage, destructive failures, and service interventions, for example.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. An imaging apparatus comprising:
a scanning printer carriage;
a carriage motor;
a transmission belt between the carriage motor and the scanning printer carriage;
a data control unit to provide instructions for effecting movement of the scanning printer carriage to the carriage motor, and print data to the scanning printer carriage; and
a power source to supply power to the carriage motor, and the scanning printer carriage, wherein:
the data control unit transmits print data to the scanning printer carriage
through an electrically conductive element in the transmission belt, and
the power source transmits power to the scanning printer carriage through the electrically conductive element in the transmission belt.

2. The imaging apparatus according to claim 1, wherein: the imaging apparatus is a printer device/printer system.

3. The imaging apparatus according to claim 1, wherein: the imaging apparatus comprises a plurality of electromagnetic induction coils along the scanning axis of the scanning printer carriage.

4. The imaging apparatus according to claim 1, wherein: the data control unit transmits print data for a single carriage scan in a burst.

5. An imaging apparatus comprising:
a scanning printer carriage;
a carriage motor;
a transmission belt between the carriage motor and the scanning printer carriage;
a data control unit to provide instructions for effecting movement of the scanning printer carriage to the carriage motor, and print data to the scanning printer carriage; and
a power source to supply power to the carriage motor, and the scanning printer carriage, wherein:
the data control unit transmits print data to the scanning printer carriage through an electrically conductive element in the transmission belt, and
the power source transmits power to the scanning printer carriage by electromagnetic induction.

6. The imaging apparatus according to claim 5, wherein: the imaging apparatus is a printer device/printer system.

7. The imaging apparatus according to claim 5, wherein: the data control unit transmits print data for a single carriage scan in a burst.

8. A method comprising:
transmitting, within a printer system, print data from a data control unit to a scanning printer carriage through an electrically conductive element in a transmission belt between a carriage motor and the scanning printer carriage; and
transmitting, within the printer system, power from a power source to the scanning printer carriage through the electrically conductive element in the transmission belt or by electromagnetic.

9. The method according to claim 8, wherein both the print data and the power are transmitted to the scanning printer carriage through the electrically conductive element in the transmission belt.

10. The method according to claim 8, wherein the power is transmitted to the scanning printer carriage by electromagnetic induction.

11. A non-transitory computer-readable storage medium comprising a set of computer-readable instructions stored thereon which, when executed by a processor associated with a printer system a first imaging device, cause the at least one processor to:
transmit, within the printer system, print data from a data control unit to a scanning printer carriage
through an electrically conductive element in a transmission belt between
the carriage motor and the scanning printer carriage; and
transmit, within the printer system, power from a power source to a scanning printer carriage
through the electrically conductive element in the transmission or
by electromagnetic induction.

12. The non-transitory computer-readable storage medium according to claim 11, wherein both the print data and the power are transmitted to the scanning printer carriage through the electrically conductive element in the transmission belt.

13. The non-transitory computer-readable storage medium according to claim 11, wherein the power is transmitted to the scanning printer carriage by electromagnetic induction.

* * * * *